United States Patent [19]

Halliday

[11] Patent Number: 5,013,043

[45] Date of Patent: May 7, 1991

[54] GAME

[76] Inventor: Walter Halliday, 5 Stevenage Road, Hitchin, Hertfordshire SG4 9DH, England

[21] Appl. No.: 421,196

[22] Filed: Oct. 13, 1989

[30] Foreign Application Priority Data

Oct. 17, 1988 [GB] United Kingdom ..... 8824214

[51] Int. Cl.[5] ..... A63F 3/00

[52] U.S. Cl. ..... 273/258; 273/281; 273/284; 273/287

[58] Field of Search ..... 273/281, 284, 241, 287, 273/271, 248, 258

[56] References Cited

U.S. PATENT DOCUMENTS

| | | | |
|---|---|---|---|
| 2,926,917 | 3/1960 | Kriz | 273/284 |
| 2,967,714 | 1/1961 | Calabrese | 273/271 |
| 3,708,171 | 1/1973 | Kunik et al. . | |
| 3,797,829 | 3/1974 | Heller | 273/271 |
| 4,723,776 | 2/1988 | Bean . | |

FOREIGN PATENT DOCUMENTS

| | | | |
|---|---|---|---|
| 374474 | 4/1923 | Fed. Rep. of Germany | 273/281 |
| 452420 | 2/1968 | Switzerland | 273/281 |
| 1402193 | 8/1975 | United Kingdom . | |
| 2149675 | 6/1985 | United Kingdom . | |

*Primary Examiner*—Benjamin Layno

*Attorney, Agent, or Firm*—Young & Thompson

[57] ABSTRACT

A game comprises a frame and a plurality of independently rotatable members held captive, in play, in the frame, wherein the rotatable members are set in a predetermined array and each is provided with a plurality of surface markings which define distinct, independently distinguishable rotational settings for each member. The members are rotatable between the settings and the frame is marked with pathways which are used in conjunction with rules to determine a player's progress. The game may also be embodied as a video game using a display screen and controller.

3 Claims, 2 Drawing Sheets

GAME

FIELD OF THE INVENTION

This invention relates to games, and is particularly concerned with games which are designed for two or more players and which are based upon the actual or perceived rotation of rotatable balls or other rolling elements.

In contrast to conventional board games which are played upon a flat surface, the present invention, in one embodiment, is concerned with a three-dimensional game based upon the use of rolling elements, preferably balls, which are mounted so as to be captive within a frame or housing. The game can also be embodied as a video game.

SUMMARY OF THE INVENTION

In accordance with the present invention there is provided a game comprising a frame or housing, and a plurality of independently rotatable members held captive, in play, in the frame or housing, wherein the rotatable members are set in a predetermined array and each is provided with a plurality of surface markings which define distinct, independently distinguishable rotational settings for each member, with each said member being manually rotatable between its said settings.

Preferably, the rotatable members are balls which are provided with surface markings which define six independently distinguishable rotational settings. This can be achieved for example by providing four equally spaced markings around the equator of the ball and a further marking at each pole. For example, these surface markings can be spots of different colours.

The rotatable members are preferably held captive within the frame or housing in such a manner that only a portion or portions of the members are visible to the players, with some of the surface markings being hidden from view. For example, the rotatable members may be located within a box-like housing which is provided with a plurality of holes through which the rotatable members partly protrude. Alternatively, the rotatable members may be mounted in a frame, for example a vertical frame, so that the rotatable members protrude on two opposite sides of the frame.

The frame or housing is preferably provided with pathway indicating means between the array of rotatable members, to indicate pathways through the array represented by said rotatable members. In the playing of the game a counter or marker can be moved by a player along these pathways only as permitted by the rotatable members displaying visible surface markings in accordance with the rules by which the game is to be played.

Also in accordance with the invention there is provided a video game to be played on a visual display screen, the game display comprising a representation of a plurality of independently rotatable members set in a predetermined array and each provided with a plurality of surface markings which define distinct, independently distinguishable rotational settings for each member, and control means operative to effect a perceived rotation of each said member between its said settings.

BRIEF DESCRIPTION OF THE DRAWINGS

In order that the invention may be more fully understood, two presently preferred embodiments of the game in accordance with the invention will now be described by way of example and with reference to the accompanying drawings, in which.

DESCRIPTION OF THE PREFERRED EMBODIMENTS

Figure 1:
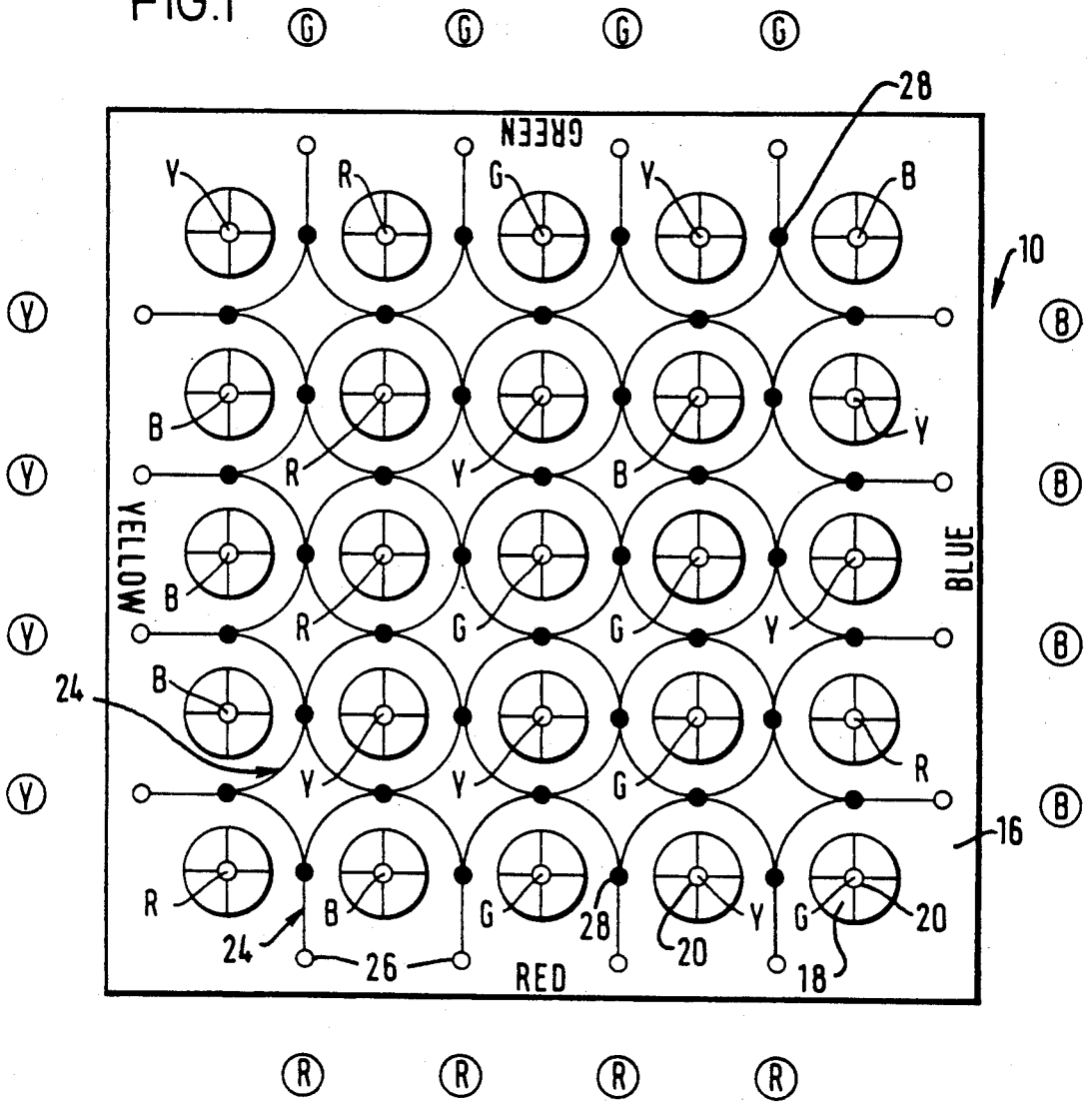
FIG. 1 is a top plan view of a first embodiment of the game in accordance with the invention.
Figure 2:
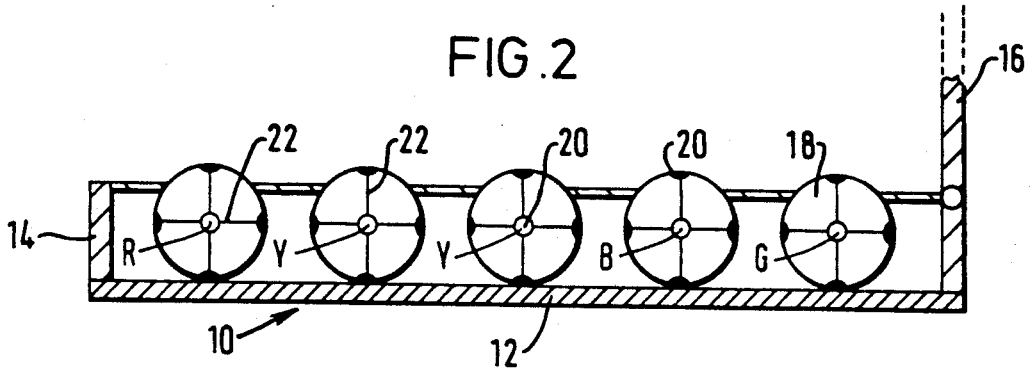
FIG. 2 is a side view, in section, through the game shown in FIG. 1.

Referring first to FIGS. 1 and 2, the game there shown comprises a box-like housing, indicated generally at 10. The housing 10 comprises a base 12, side walls 14 and a hinged lid 16 which is connected to one of the side walls. Positioned within the housing 10 are twenty five spherical balls 18, arranged in a five by five array. The balls 18 are preferably set into shallow recesses in the base 12 in order to locate them in position when the lid is open. The lid 16 is provided with a corresponding array of twenty five holes, so that when the lid is lowered into a position parallel with the base 12 the upper portion only of each ball 18 protrudes through the respective holes in the lid 16, as illustrated in FIG. 1.

Each of the balls 18 is manually rotatable within the housing, although held captive within the housing by virtue of its dimensions in relation to the holes in the lid. As shown in the drawings, each ball 18 is provided with six spot markings 20. Four of these are positioned equally spaced around the equator of each ball, with a further spot marking at each pole. The six spot markings 20 are connected by lines 22. These lines 22 indicate the directions in which the balls 18 should be rotated in order to bring an adjacent spot marking 20 into a visible position at the top of the ball. The six spot markings 20 on each ball 18 are all different in some way in order that each spot marking 20 on a given ball should be distinguishable from each of the other five markings. This can be achieved for example by using spot markings of six different colours, or alternatively by numbering each spot marking from 1 to 6. For example, the spot markings may be white, black, red, blue, green, and yellow. In FIG. 1, the letters R, B, G and Y of course refer to these last four colors, respectively. Alternatively, the characteristic markings may be letters of the alphabet, or words, in which latter case the players will be attempting to make sentences by the rotation of the balls.

Marked on the upper surface of the lid 16 of the housing are pathway lines 24 which begin at starting points 26 outside the array, adjacent to the edge of the housing, and which then extend into and through the array. Temporary stopping points 28 are marked between each pair of balls 18. The four starting points 26 along each side of the housing are individually designated, such as "red" "blue" "green" "yellow". These colour designations of course match up with the spot markings 20 on the balls 18.

It should be appreciated that the independently distinguishable spot markings 20 on the balls 18 are not in the same relative positions on each ball. In other words, rotation of two balls through an angle of 90° each in the same direction will not necessarily bring a spot marking of the same colour or number to the top of the two balls.

This gives the game the necessary degree of chance or randomness.

In play, all the balls 18 will first be turned, after lifting the lid, so that the black spots 20 for example are at the top. The "red" player will place four red counters or markers on his four "red" starting points 26. Each other player does likewise. The "red" player is then allowed one or two moves in which he is permitted to rotate one or two of the balls 18 each through 90° in order to bring to the top a different distinguishing spot or mark. If he succeeds in obtaining a red spot on the top of two adjacent balls then he is permitted to move the relevant counter forward to the temporary stopping point 28 which is mid-way between those two balls. That counter can then be advanced further, along one of the arcuate pathways 24, if that player is able to move on to the next temporary stopping point 28 by virtue of having rotated the two balls on each side of the stopping point so that they both show a red spot on top. Play continues by the players in turn, with each player trying to move his own counters or markers across the board from the starting side to the opposite side. Rules govern the mode of play, including for example how many turns each player may have before the next player takes his turn, whether penalties are imposed, etc. The present invention is not concerned with the particular rules of play, but with the principle of the game itself and the game apparatus by means of which that principle is put into practice.

Figure 3:
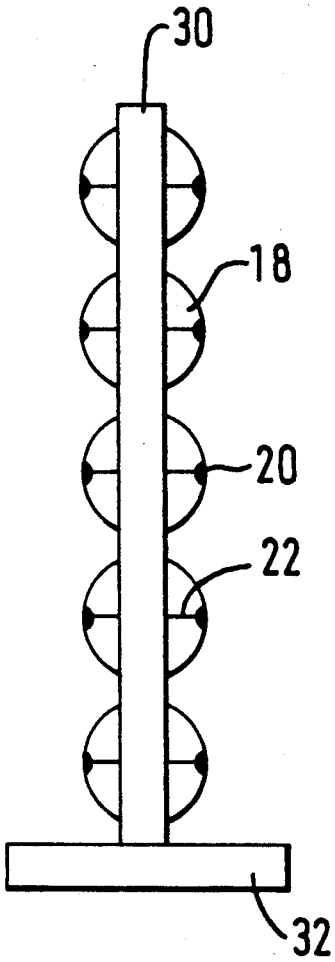
FIG. 3 shows a second embodiment of the game in accordance with the invention based upon the use of a vertical frame; and, FIG. 4 is an illustration of the game embodied as a video game.

FIG. 3 shows an alternative embodiment, where the balls 18, instead of being arrayed within a box-like housing, are arrayed in a vertical frame 30 which is supported on a stand 32. The frame 30 is provided with an array of twenty five holes therethrough, with means to retain the individual balls 18 captive within the holes, while still permitting rotation of the balls to bring the various independently distinguishable markings 20 to the position where they are most prominent from the plane of the frame. With this vertical frame structure two players on opposite sides of the frame can play the game, competing against each other by rotating the balls with a view to completing their own pathways across the array. In this vertical arrangement the pathways between the balls can be dotted with small magnets at the temporary stopping points and the markers or counters can be such as to be held in place by the small magnets.

The five by five array of balls shown in the drawings is considered to be an effective size of game in terms of the numbers of balls. A smaller, four by four array reduces the number of possibilities, particularly with four players, whereas a six by six array would provide so many possibilities that the game would take too long and the players would lose interest. However, in principle, the game of the present invention could be applied to an array of any number of rotatable members. Also, the game of the present invention is not limited to a square array of rotatable members. Alternative arrays could be envisaged within the scope of the invention. For example, a game for six players could be based upon a hexagonal array. It should be understood that the particular array or configuration of the rotatable members is not a limiting feature of the present invention, nor is the particular configuration of surface markings on the rotatable members which is used in the drawings to illustrate the invention. Any alternative surface markings may be used which would define distinct, independently distinguishable rotational settings for each of the rotatable members.

Figure 4:
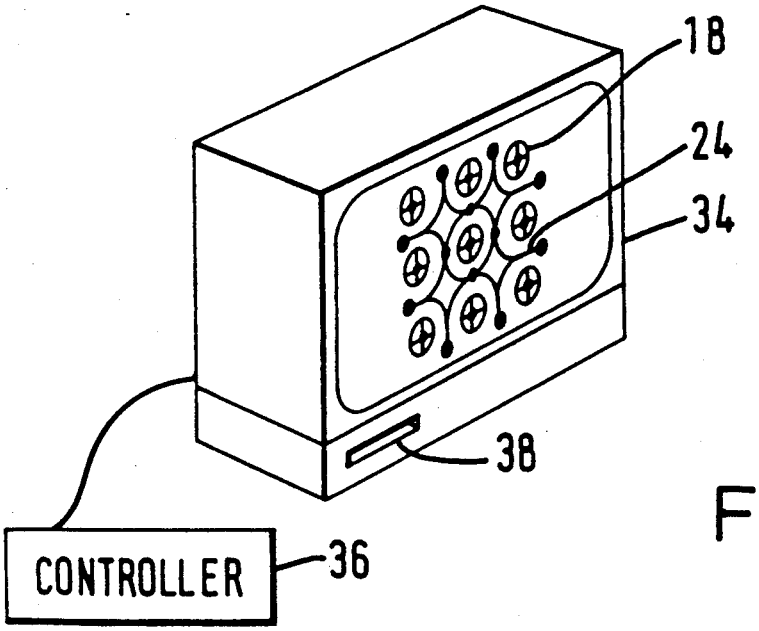

As shown in FIG. 4, the game of the present invention can also be embodied as a video game, using a video display unit 34 and keyboard, joystick or other control means 36, instead of using a three-dimensional frame or housing as described above. The game apparatus has a slot 38 to receive a cassette or disc which carried the game program. In this embodiment the screen will display representations of the rotatable members 18, in similar manner to the view shown in FIG. 1, and by using the keyboard or other control means 36 the players are able to effect "rotation" of the "balls" and movement of their "counters" along the pathways 24. In FIG. 4 a three by three array of "balls" 18 is shown by way of example. Instead of moving "counters" along the pathways one could alternatively have illuminated pathways with sections becoming illuminated as progress is made.

I claim:

1. A game comprising a frame or housing, a plurality of independently rotatable balls held captive, in play, in a predetermined array in the frame or housing in such a manner that the balls partly protrude through respective holes in the frame or housing so that only a portion or portions of each ball is visible to players, wherein each ball is provided with four equally spaced surface markings around the equator of the ball and a further surface marking at each pole thereby to define sic independently distinguishable rotational setting for each ball, with each ball being manually rotatable between its said settings, and with some of the surface markings of each ball always being hidden from view, wherein the frame or housing is provided with markings indicating pathways between the array of balls, and a plurality of sets of counters for movement along the pathways indicated by the then-present surface markings visible on the balls, each set of counters having a distinct marking to distinguish each set of counters from each other set, and the distinct markings on the counters having counterparts among the surface markings on the balls such that each ball has among its surface markings a marking corresponding to each distinct set of counters.

2. A game as claimed in claim 1, in which the balls are mounted in a vertical frame so that the balls protrude on two opposite sides of the frame.

3. A game as claimed in claim 1, in which said pathways comprise a plurality of arcuate lines each circumscribing a quarter of the circumference of one of said balls, with stopping points between and linking adjacent arcuate lines.

* * * * *